US005724077A

United States Patent [19]

Murata

[11] Patent Number: 5,724,077

[45] Date of Patent: Mar. 3, 1998

[54] DRIVING METHOD FOR AN INK JET RECORDING DEVICE HAVING A PLURALITY OF RECORDING HEADS

[75] Inventor: Yuji Murata, Ebina, Japan

[73] Assignee: Fuji Xerox Co., Ltd., Tokyo, Japan

[21] Appl. No.: 574,783

[22] Filed: Dec. 19, 1995

Related U.S. Application Data

[63] Continuation of Ser. No. 123,074, Sep. 20, 1993, abandoned.

[30] Foreign Application Priority Data

Oct. 8, 1992 [JP] Japan ..... 4-296471

[51] Int. Cl.[6] ..... B41J 29/38

[52] U.S. Cl. ..... 347/12; 347/43

[58] Field of Search ..... 347/12, 13, 43, 347/180, 182, 174, 40

[56] References Cited

U.S. PATENT DOCUMENTS

| | | | |
|---|---|---|---|
| 4,300,144 | 11/1981 | Isayama et al. | 347/12 |
| 4,540,996 | 9/1985 | Saito | 347/43 |
| 4,760,408 | 7/1988 | Kanayama | 347/43 |
| 5,142,296 | 8/1992 | Lopez et al. | 347/12 |

FOREIGN PATENT DOCUMENTS

| | | | |
|---|---|---|---|
| 57-138953 | 8/1982 | Japan . | |
| 58-136451 | 8/1983 | Japan . | |
| 60-228158 | 11/1985 | Japan | 347/43 |
| 3-227632 | 10/1991 | Japan . | |
| 4-41262 | 2/1992 | Japan . | |

*Primary Examiner*—Benjamin R. Fuller
*Assistant Examiner*—Craig A. Hallacher
*Attorney, Agent, or Firm*—Oliff & Berridge

[57] ABSTRACT

A recording head driving method in an ink jet recording device including a plurality of recording heads each having a plurality of nozzles, the plurality of nozzles in each of the recording heads being grouped into a plurality of blocks. The plurality of blocks are divisionally driven, and a drive timing of at least one of the recording heads is shifted from drive timings of the other recording heads. Accordingly, a peak power consumption can be suppressed to thereby reduce the capacity of a power source and reduce the overall size of the ink jet recording device.

6 Claims, 5 Drawing Sheets

DRIVING METHOD FOR AN INK JET RECORDING DEVICE HAVING A PLURALITY OF RECORDING HEADS

This is a Continuation of application Ser. No. 08/123,074 filed Sep. 20, 1993, now abandoned.

BACKGROUND OF THE INVENTION

1.[Field of the Invention]

The present invention relates to a recording head driving method in an ink jet recording device including a plurality of multinozzle recording heads each having a plurality of nozzles, and more particularly to a recording head driving method suitably applied to a color ink jet recording device including four recording heads for four colors of black (K), cyan (C), magenta (M), and yellow (Y).

2.[Description of the Related Art]

An ink jet recording device is generally classified into a continuous jet type and an on-demand type utilizing piezoelectric elements or electric heaters. In the on-demand type of ink jet recording device, a thermal ink jet type utilizing electric heaters has recently been remarkable because micromachining of nozzles is easy to conduct and it is therefore possible to form a plurality of nozzles in a recording head (namely, a multinozzle recording head). In such a multinozzle recording head, each nozzle is provided with an electric heater. However, when many electric heaters for the nozzles are simultaneously driven, a power consumption increases or inks discharged from the nozzles interfere with each other between the nozzles to adversely affect an image quality. To cope with these problems, divisional driving of the nozzles is generally employed in such a manner that the nozzles are grouped into a plurality of blocks and these blocks are sequentially driven. Conventional driving techniques employing such divisional driving are described in Japanese Patent Laid-open Publication Nos. 58-136451 and 3-227632, for example. These techniques are intended to reduce the capacity of a power source and suppress an adverse effect such as pressure fluctuation in a common ink chamber.

In a recording device having a plurality of recording heads, such as a color printer, even utilizing the above-mentioned divisional driving, however, there is a possibility that the plural recording heads may be simultaneously driven. FIG. 5 is a timing chart illustrating a conventional driving method for four ink jet recording heads for four colors K, C, M, and Y. Each of the recording heads has 128 nozzles which are grouped into 32 blocks each having four nozzles. The 32 blocks in each recording head are sequentially driven. When a print start signal is applied to each recording head, the first block (#1 to #4 nozzles) of each recording head starts to drive, and follows sequential driving of the other blocks until one cycle of print operation is terminated. During one cycle of print operation, the four recording heads for the colors K, C, M, and Y are simultaneously driven. When the number of the blocks in each recording head is N, a peak power consumption can be suppressed to 1/N of that in the case where all the nozzles in each recording head are simultaneously driven. In the example shown in FIG. 5, the 128 nozzles in each recording head are grouped into the 32 blocks, and the peak power consumption in each recording head becomes 1/32 of the peak power consumption in the case where the 128 nozzles are simultaneously driven. However, since the four recording heads for the four colors K, C, M, and Y are simultaneously driven as apparent from FIG. 5, the peak power consumption in the four recording heads as a whole to be required becomes four times that in each recording head. As a result, the capacity of a power source increases and the overall size of an ink jet recording device also increases to cause an increase in cost.

SUMMARY OF THE INVENTION

It is accordingly an object of the present invention to provide a recording head driving method in an ink jet recording device such as a color printer having a plurality of recording heads, which can reduce the capacity of a power source and reduce the overall size of the ink jet recording device.

According to the present invention, there is provided in a recording head driving method in an ink jet recording device including a plurality of recording heads each having a plurality of nozzles, said plurality of nozzles in each of said recording heads being grouped into a plurality of blocks; the improvement wherein said plurality of blocks are divisionally driven, and a drive timing of at least one of said recording heads is shifted from drive timings of the other recording heads.

In the recording head driving method of the present invention, a plurality of blocks of nozzles in each recording head are divisionally driven, and a drive timing of at least one of the recording heads is shifted from drive timings of the other recording heads. For example, when the number of blocks in each recording head is N and the number of recording heads is n, the peak power consumption can be suppressed to 1/nN of the peak power consumption in the case where all the nozzles of all the recording heads are simultaneously driven.

As described above, not all the recording heads are simultaneously driven according to the present invention. Accordingly, the capacity of a power source for the ink jet recording device can be reduced, and the overall size of the ink jet recording device can also be reduced, thereby reducing the costs.

Other objects and features of the invention will be more fully understood from the following detailed description and appended claims when taken with the accompanying drawings.

DETAILED DESCRIPTION OF THE PREFERRED EMBODIMENTS

Figure 1:
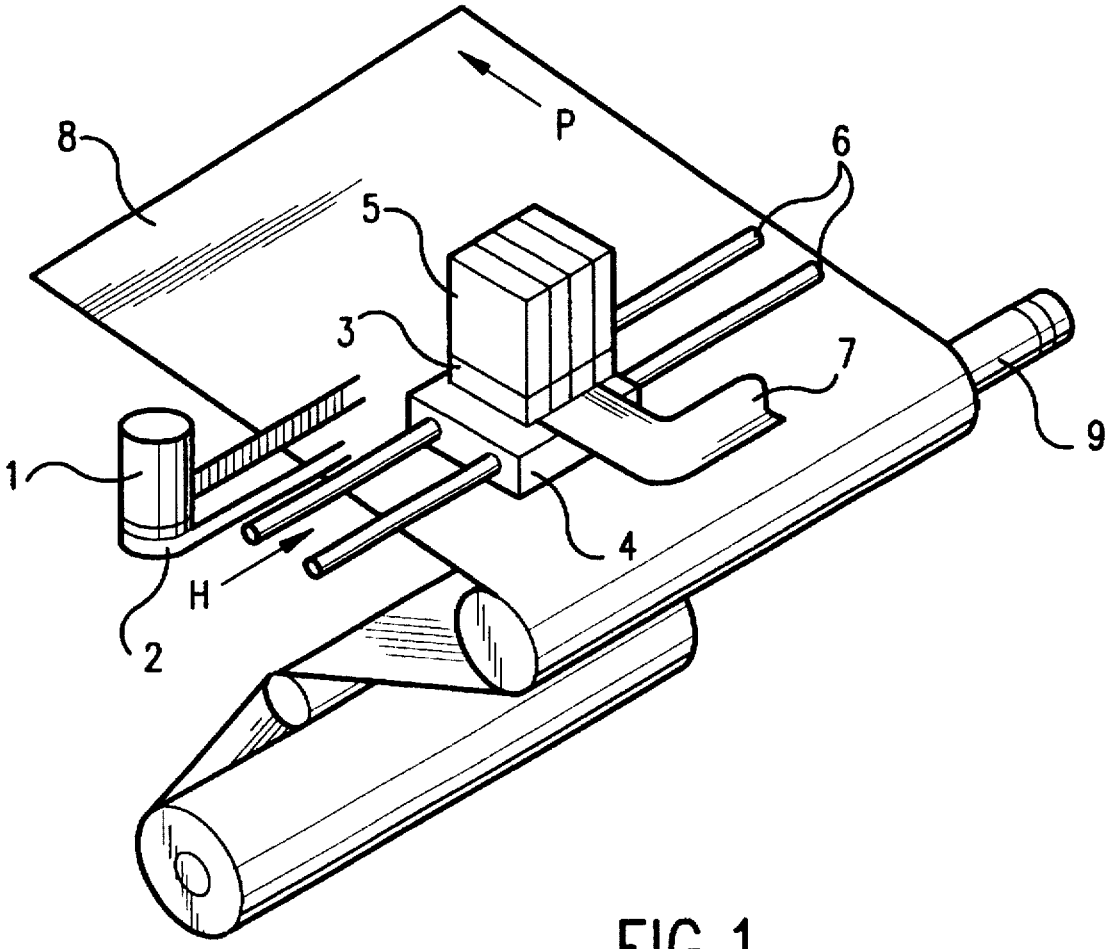
FIG. 1 is a schematic perspective view of an example of an ink jet printer to which the recording head driving method of the present invention is applied.

Referring to FIG. 1, there is shown in schematic perspective an example of a serial type ink jet printer to which the recording head driving method according to the present invention is applied. The serial type ink jet printer shown in FIG. 1 includes a carriage drive motor 1, a timing belt 2, four recording heads 3, a carriage 4, four ink tanks 5, a pair of carriage guides 6, a cable 7, a recording paper 8, and a paper feed motor 9.

The recording heads 3 are mounted on the carriage 4. The carriage 4 is slidably supported on the carriage guides 6 so as to be reciprocatable in a horizontal scanning direction depicted by an arrow H. The timing belt 2 is driven by the carriage drive motor 1 to reciprocatably move the carriage 4 in the horizontal scanning direction. The four recording heads 3 are arranged side by side in the horizontal scanning direction to effect color printing in four colors K, C, M, and Y. While the order of arrangement of the four recording heads 3 corresponds to the order of K, C, M, and Y in this example, any other orders of arrangement may be selected. The cable 7 is connected to each recording head 3 to supply electric power to a heater (not shown) and transmit a signal to a drive circuit (not shown). The four ink tanks 5 are mounted on the four recording heads 3, respectively, to supply inks of the four colors K, C, M, and Y to the four recording heads 3. The recording paper 8 is fed by the paper feed motor 9 in a vertical scanning direction depicted by an arrow P.

Figure 2:
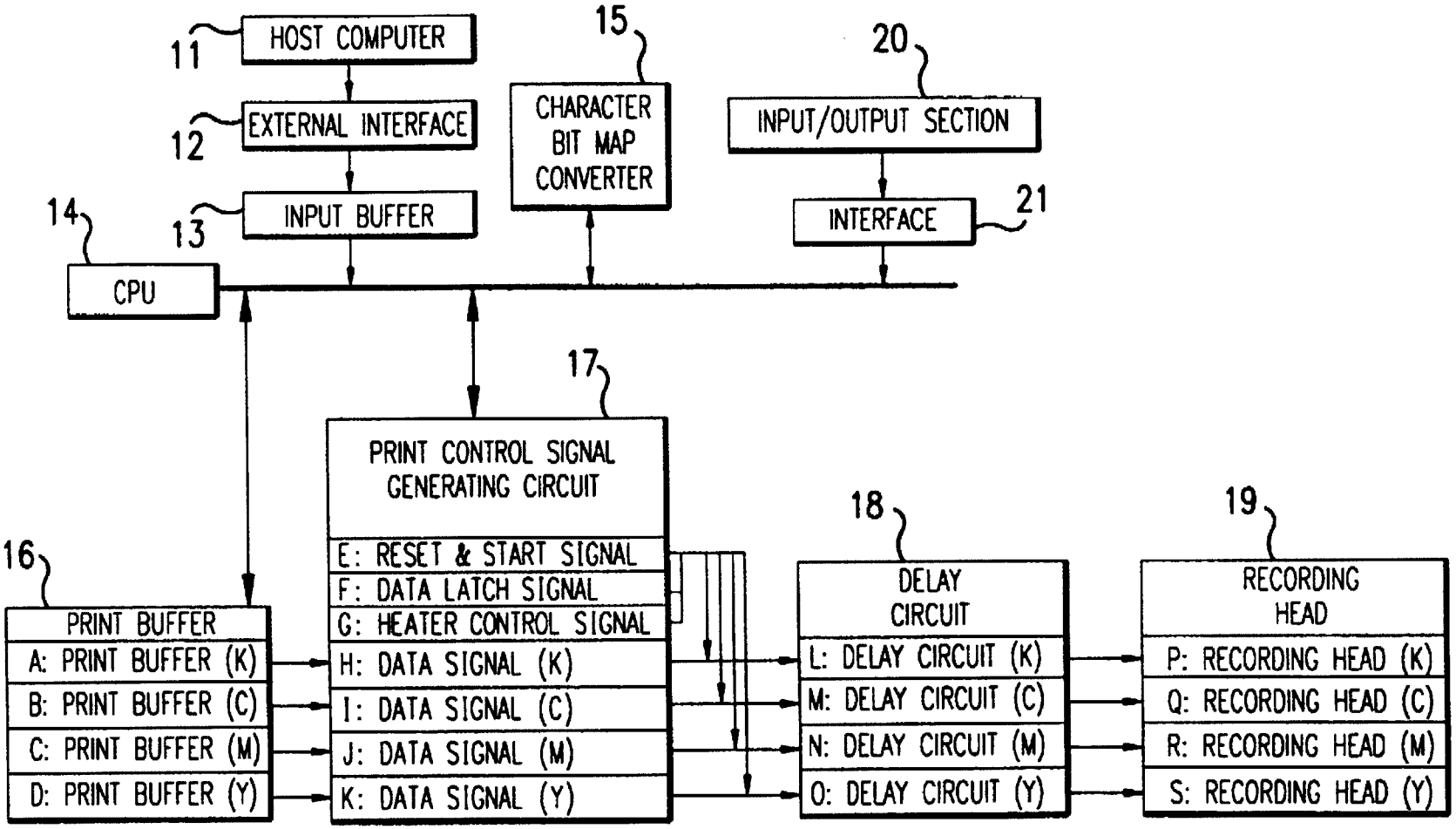
FIG. 2 is a block diagram of an ink jet recording device to which the recording head driving method of the present invention is applied.

Referring next to FIG. 2, there is shown a block diagram of an ink jet recording device to which the recording head driving method according to a preferred embodiment of the present invention is applied. The system including the ink jet recording device shown in FIG. 2 includes a host computer 11, an external interface 12, an input buffer 13, a CPU 14, a character bit map converter 15, a print buffer 16, a print control signal generating circuit 17, a delay circuit 18, a recording head 19, an input/output section 20, and an interface 21.

The ink jet recording device is generally controlled by the CPU 14. The input/output section 20 is operated by a user to effect various settings of the ink jet recording device, instruction to recording, etc. Data input from the input/output section 20 is transmitted through the interface 21 to the CPU 14. Further, various messages to the user, a state of the recording device, etc. are output from the CPU 14 through the interface 21 to the input/output section 20, from which the user is informed of the messages, etc.

Print data transmitted from the host computer 11 is stored through the external interface 12 into the input buffer 13. When the print data is character data, it is converted into bit map data in the character bit map converter 15, and the bit map data is then stored as a bit map image into the print buffer 16. Alternatively, the character data is converted by the CPU 14 on the basis of bit map data previously stored in the character bit map converter 14, and the bit map data converted is then stored as a bit map image into the print buffer 16. When the print data transmitted from the host computer 11 is bit map data, it is directly stored into the print buffer 16. The print buffer 16 consists of four individual buffers for the four colors K, C, M, and Y, and the bit map data is divided and stored into the four individual buffers.

The delay circuit 18 consists of four individual delay circuits for the four colors K, C, M, and Y. Similarly, the recording head 19 consists of four individual recording heads for the four colors K, C, M, and Y.

When receiving an output demand signal from the input/output section 20 or the host computer 11, the CPU 14 applies a start signal to the print control signal generating circuit 17. When receiving the start signal, the print control signal generating circuit 17 reads the print data from the print buffer 16 and generates various print control signals for controlling divisional driving such that a plurality of jet nozzles in each recording head 19 are grouped into a plurality of blocks which are driven sequentially and intermittently. The print control signals include a reset and start signal for starting driving of each recording head 19, a data latch signal for latching the print data signal of each color, and a heater control signal for controlling a heater on each recording head 19. Then, the print control signals from the print control signal generating circuit 17 are transferred to each delay circuit 18, and the print data signal of each color is also transferred to each delay circuit 18.

Each delay circuit 18 functions to delay the print control signals by a predetermined delay quantity for each color, so as to control a drive timing of each recording head 19 in a delay fashion. In this preferred embodiment, the heater control signal is delayed for each recording head 19. Alternatively, the print data signal and the data latch signal in addition to the heater control signal may be delayed for each recording head 19.

When receiving the reset and start signal from each delay circuit 18, each recording head 19 starts one cycle of print operation. The print data signal is latched according to the data latch signal to set data to be printed, that is, to determine which of the nozzles should be energized. The heater corresponding to each nozzle to be energized is supplied with current according to the heater control signal, thereby driving the nozzles selected. When the nozzles are selectively driven, bubbles are generated over the corresponding heaters to apply pressure to the ink supplied to each recording head 19, thereby discharging the ink from the selected nozzles in each recording head 19 to effect printing.

Figure 3:
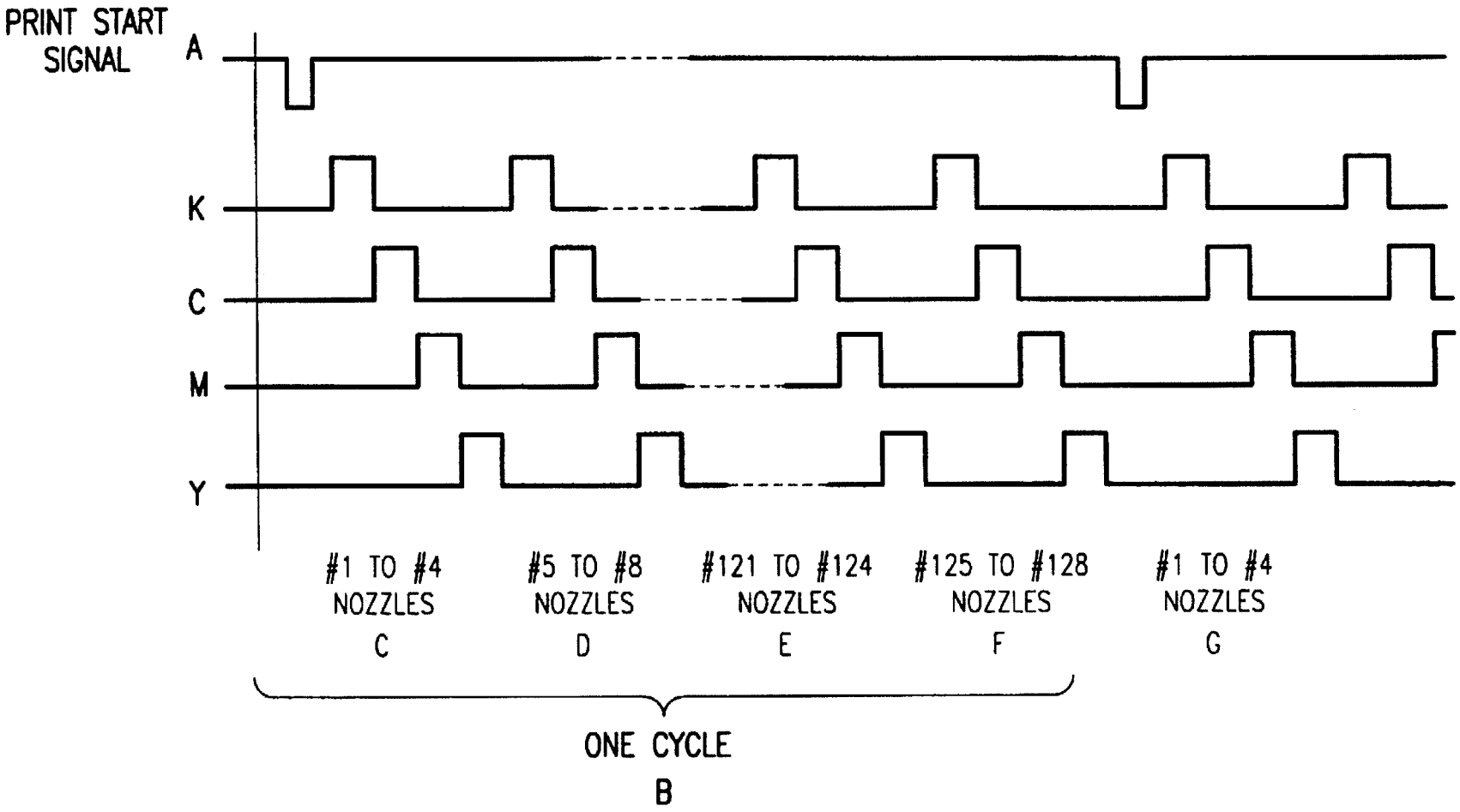
FIG. 3 is a timing chart of the recording head driving method according to a preferred embodiment of the present invention.

Referring to FIG. 3, there is shown a timing chart of a preferred embodiment of the recording head driving method according to the present invention. Each of the recording heads 19 for the four colors K, C, M, and Y has 128 nozzles, for example. The 128 nozzles of each recording head 19 are grouped into 32 blocks each having four nozzles. When receiving the print start signal from each delay circuit 18, each recording head 19 starts to be driven, and each block of the nozzles is driven sequentially and intermittently. Thus, all the blocks in each recording head 19 are driven during one cycle of print operation.

Figure 5:
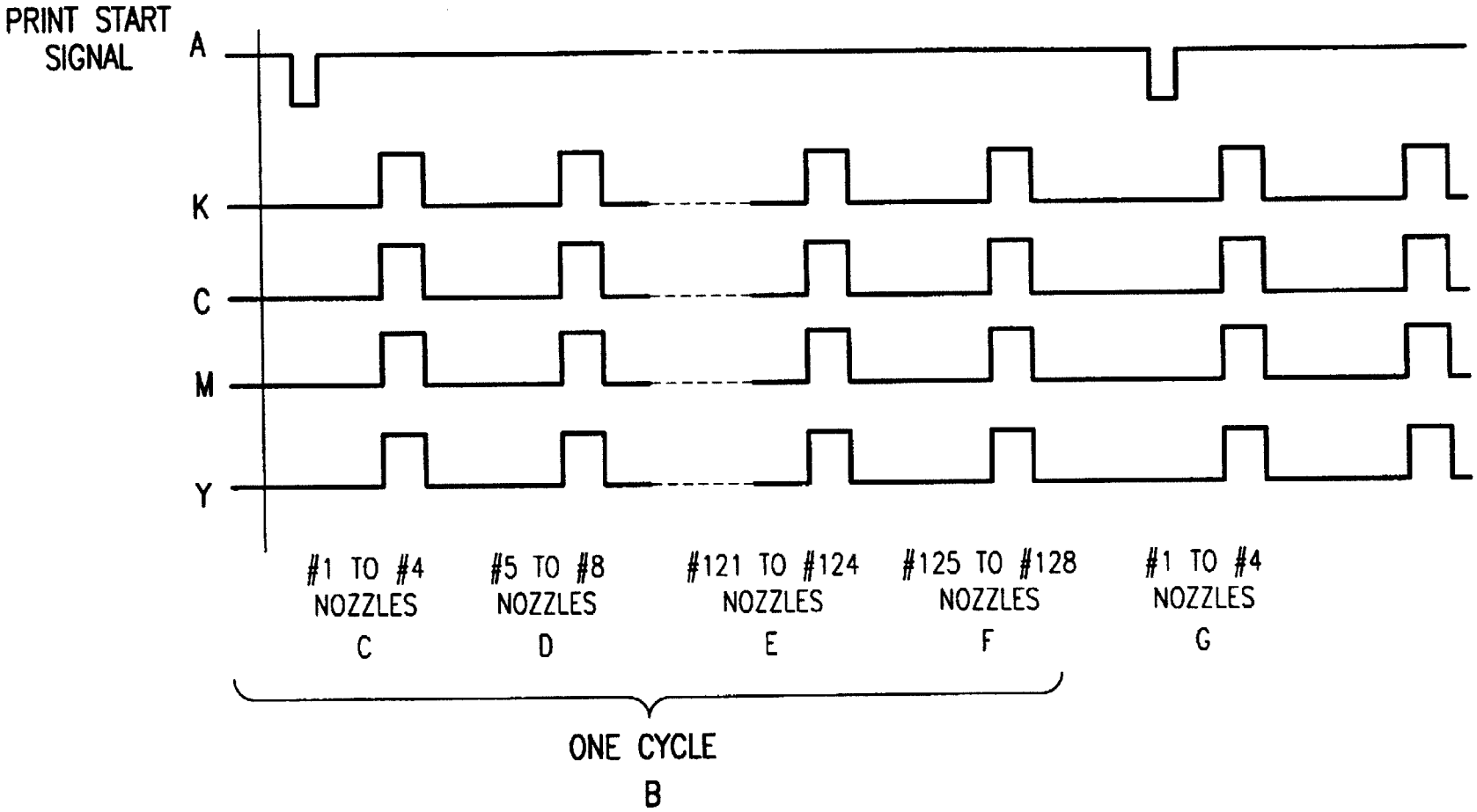
FIG. 5 is a timing chart showing a recording head driving method in the prior art.

In this preferred embodiment, the heater control signal to be applied to each recording head 19 is delayed by a quantity preliminarily determined for each recording head 19. More specifically, as shown in FIG. 3, when the print start signal is applied to each recording head 19, the heaters for the first block (#1 to #4 nozzles) of the recording head 19 for the color K becomes ON without delay of the heater control signal to continue to be driven for a predetermined time. Thereafter, the recording head 19 for the color K becomes OFF. During this predetermined time, the heater control signal to be applied to the recording head 19 for the color C is delayed. That is, at the time the recording head 19 for the color K becomes OFF, the heaters for the first block (#1 to #4 nozzles) of the recording head 19 for the color C becomes ON. Similarly, until the recording head 19 for the color C becomes OFF, the heater control signal to be applied to the recording head 19 for the color M is delayed; and until the recording head 19 for the color M becomes OFF, the heater control signal to be applied to the recording head 19 for the color Y is delayed. In this manner, the first blocks of all the recording heads 19 for the colors K, C, M, and Y are sequentially driven so that the ON periods of all the recording heads 19 are not overlapped with each other. After the first blocks of all the recording heads 19 end to drive (i.e., after the first block of the recording head 19 for the color Y becomes OFF in this case), the second blocks (#5 to #8 nozzles) of all the recording heads 19 start to drive (i.e., the second block of the recording head 19 for the color K becomes ON in this case). Subsequently, the remaining blocks of all the recording heads 19 are sequentially driven in the same manner as the above until the 32nd block, or the last block of the recording head 19 for the color Y ends to drive. Thus, one cycle of print operation is ended. According to the driving method of the preferred embodiment, all the blocks of each recording head 19 are driven sequentially and intermittently, and the four recording heads 19 are sequentially driven in the same block. Accordingly, a peak power consumption becomes electric energy required for driving the four nozzles in one block. In other words, the peak power consumption in this preferred embodiment can be suppressed to ¼ of the peak power consumption in the prior art wherein all the recording heads are simultaneously driven as shown in FIG. 5.

Figure 4:
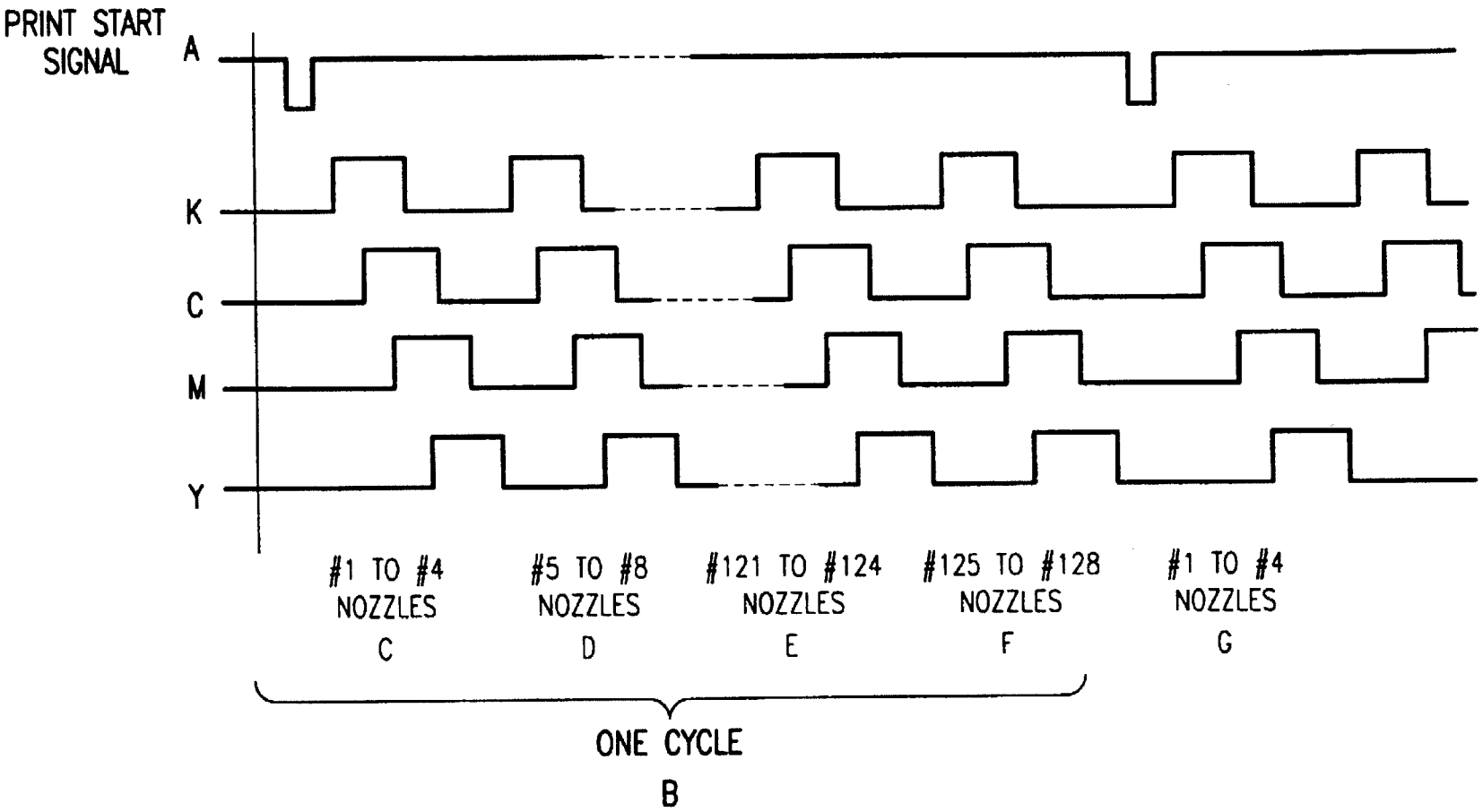
FIG. 4 is a timing chart similar to FIG. 3, showing another preferred embodiment of the present invention.

Referring to FIG. 4, there is shown a timing chart of another preferred embodiment of the recording head driving method according to the present invention. In the previous preferred embodiment described with reference to FIG. 3, the heater control signal to be applied to each recording head 19 is delayed so that the ON periods of all the recording heads 19 are not overlapped with each other. However, there is a possibility of sufficient electric power, or there is a possibility of a short time interval for driving between the blocks so that there is no sufficient time for sequentially driving the recording heads 19. In these cases, the heater control signals to be applied to all the recording heads 19 may be delayed so that the ON periods of all the recording heads 19 are partially overlapped with each other as shown in FIG. 4. The delay quantity in this preferred embodiment is set so that all the recording heads 19 are not simultaneously driven, thereby suppressing the peak power consumption.

Although the drive timings of the recording heads 19 are delayed in the order of K, C, M, and Y in the above preferred embodiments shown in FIGS. 3 and 4, the order of delay is not limited to the above, but it may be arbitrarily determined and the delay quantity may be suitably set in each delay circuit 18 according to the order of driving of the recording heads 19.

Further, the delay of the drive timings of all the recording heads 19 is not essential. For example, the four recording heads 19 may be grouped into two sets of recording heads. When each set is constituted of two recording heads, the two recording heads in each set may be simultaneously driven, but the two sets must be driven not simultaneously. Alternatively, when one of the two sets is constituted of one recording head, and the other set is constituted of three recording heads, the three recording heads in the other set may be simultaneously driven, but the remaining one recording head must be driven not simultaneously with the three recording heads. In this manner, the heater control signals to be applied to all the recording heads 19 may be arbitrarily delayed under the conditions that at least one of all the recording heads must be driven not simultaneously with the remaining recording heads. In the above first case where two recording heads constitute each set and the driving timing of the two recording heads is shifted from that of the other two recording heads, the peak power consumption can be suppressed to ½ of the peak power consumption in the prior art all the recording heads are simultaneously driven. In the above second case where the drive timing of one recording head is shifted from that of the remaining three recording heads, the peak power consumption can be suppressed to ¾ of the peak power consumption in the prior art wherein all the recording heads are simultaneously driven.

There is a possibility of slip in printing position because the drive timings of the recording heads are shifted from each other. In this case, the relative mounting positions of the recording heads may be adjusted according to the drive timings of the recording heads.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. A driving method for an ink jet recording device having a plurality of recording heads, each of said recording heads having a corresponding plurality of nozzles directed to a recording medium, each recording head having a plurality of blocks with each block including a corresponding group of said plurality of nozzles, the driving method comprising the steps of:

divisionally driving each of said plurality of blocks for each of said recording heads directed to the recording medium by controlling print control signals for said recording heads, with said blocks being driven during a printing cycle, and shifting a drive timing of a second one of said recording heads directed to the recording medium relative to a drive timing of a first one of said recording heads during said printing cycle by delaying heater control signals applied to said second one of said recording heads relative to heater control signals applied to said first one of said recording heads such that all of said recording heads can not be simultaneously driven during said printing cycle, thereby reducing peak power consumption of said ink jet recording device during said printing cycle.

2. The recording head driving method as defined in claim 1, wherein drive timings of all of the recording heads are shifted from each other.

3. The recording head driving method as defined in claim 2, wherein the heater control signals are sequentially delayed by a predetermined delay quantity.

4. The recording head driving method as defined in claim 3, wherein said predetermined delay quantity is set so said heater control signals are not overlapping with each other.

5. The recording head driving method as defined in claim 3, wherein said predetermined delay quantity is set so said heater control signals are partially overlapping with each other.

6. The recording head driving method as defined in claim 1, further comprising the steps of:

shifting a drive timing of a third one of said recording heads relative to the drive timing of said first one of said recording heads during said printing cycle by delaying heater control signals applied to said third one of said recording heads relative to said heater control signals applied to said first one of said recording heads, and shifting a drive timing of a fourth one of said recording heads relative to the drive timing of said first one of said recording heads during said printing cycle by delaying heater control signals applied to said fourth one of said recording heads relative to said heater control signals applied to said first one of said recording heads.

* * * * *